United States Patent [19]

Gregory

[11] Patent Number: 4,968,274

[45] Date of Patent: Nov. 6, 1990

[54] PEDAL OPERATED WATERCRAFT

[76] Inventor: Jack T. Gregory, 1932 Weiss La., Penngrove, Calif. 94951

[21] Appl. No.: 379,103

[22] Filed: Jul. 13, 1989

[51] Int. Cl.[5] ..... B63H 16/20

[52] U.S. Cl. ..... 440/27; 114/61; 114/144 A

[58] Field of Search ..... 440/21-32; 114/61, 144 R, 144 A, 283, 284, 292, 345

[56] References Cited

U.S. PATENT DOCUMENTS

| | | | |
|---|---|---|---|
| 1,370,959 | 3/1921 | Greer | 440/31 |
| 1,634,257 | 7/1927 | Garro | 440/30 |
| 2,775,950 | 1/1957 | Dearmond | 440/30 |

*Primary Examiner*—Joseph F. Peters, Jr.

*Assistant Examiner*—Jesûs D. Sotelo

*Attorney, Agent, or Firm*—Melvin R. Stidham

[57] ABSTRACT

The watercraft has a catamaran hull system with parallel rear pontoons pivoted for side to side oscillation from the trailing end of front pontoons. A rigid frame interconnects the front portions, and back support post is pivoted to both the frame and to linkage interconnecting the rear pontoons, so that the operator can lean to either side to pivot the back support post and turn the boat in the direction he is leaning. Bicycle pedals rotatably carried on the front of the operator support frame, drive a propeller to propel the boat, and the foot pedaling action may be augmented by lines secured to the pedals so the operator can pull each pedal manually on return.

20 Claims, 2 Drawing Sheets

PEDAL OPERATED WATERCRAFT

BACKGROUND OF THE INVENTION

Present pedal operated watercraft are in the nature of bicycles mounted on pontoons. Such watercraft are generally relatively slow in propulsion and are difficult to maneuver.

OBJECTS OF THE INVENTION

It is an object of this invention to provide a watercraft which is highly maneuverable and which can be propelled at a relatively rapid rate.

It is a further object of this invention to provide a watercraft that can be maneuvered without the use of the hands or arms.

It is a further object of this invention to provide a watercraft that can be maneuvered while the operator's hands are freed for operating propelling means.

Other objects and advantages of this invention will become apparent from the description to follow, particularly when read in conjunction with the accompanying drawings.

SUMMARY OF THE INVENTION

In carrying out this invention I provide a catamaran hull system with parallel front pontoons and parallel rear pontoons, which are pivoted on the trailing ends of the front pontoons to act in the nature of rudders. The pilot support frame, which is mounted on and across the front pontoons, joins them rigidly together. A seat is mounted on the support frame and an upright back support post is pivoted to it so the operator can lean to either side to pivot the back support post. The back support post is also connected to the steering linkage so that, if the operator leans to one side, the rear pontoons are pivoted in the same direction to turn the boat in that direction. A propeller is driven by bicycle pedals and a pull line is secured to each pedal so that the operator can drive the pedal down with leg power and he can help by pulling it back on return with arm power, as the other leg is driving the other pedal down.

DESCRIPTION OF A PREFERRED EMBODIMENT

Figure 1:
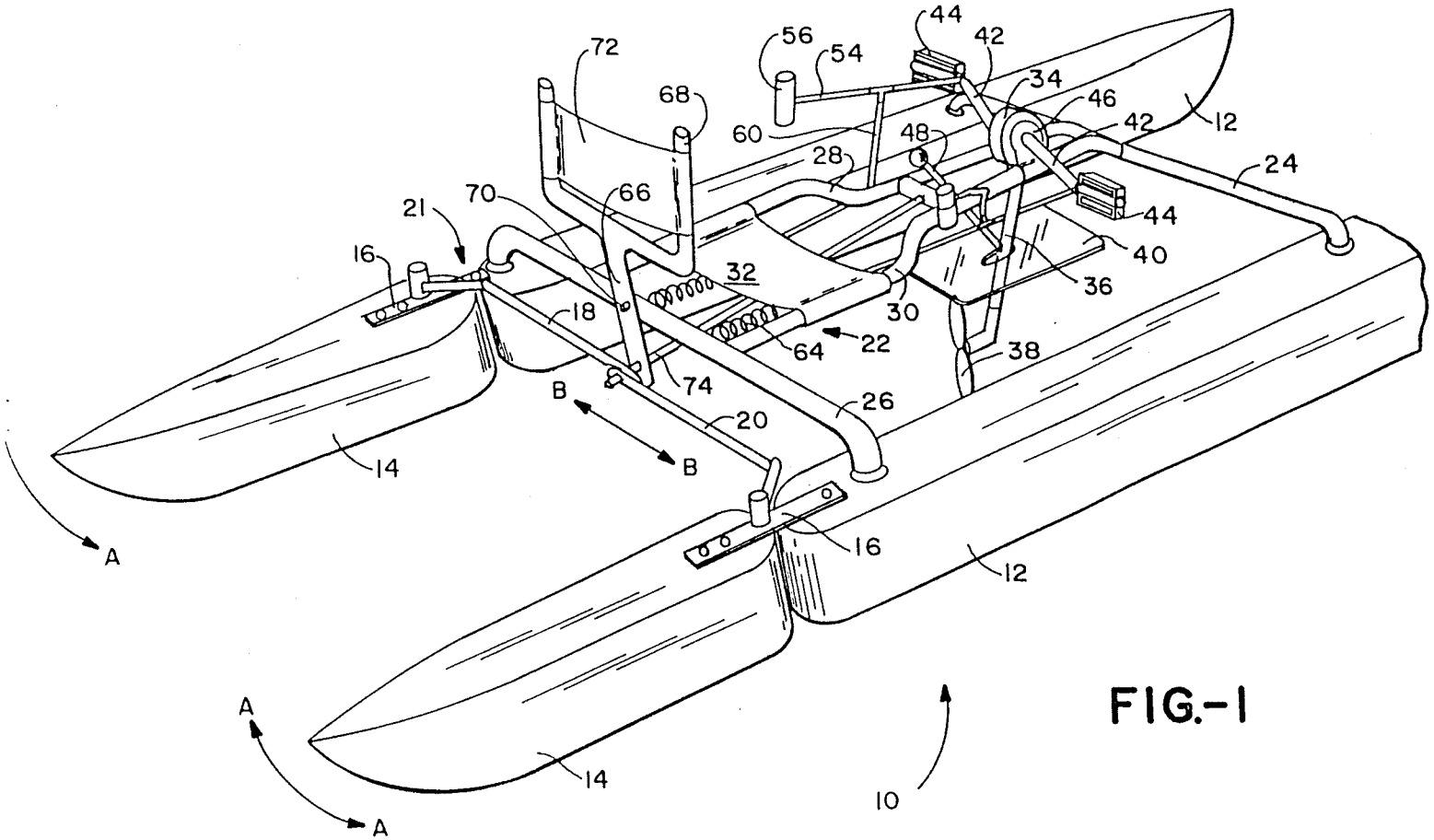
FIG. 1 is a view in perspective of a watercraft embodying features of this invention.

Referring to the drawings with greater particularity, the watercraft 10 of this invention is in the form of a catamaran with a twin hull system including a pair of parallel forward hull sections or pontoons 12 and a pair of rear hull sections or pontoons, 14 which are hingedly connected at 16 so that the rear pontoons 14 pivot together to swing from side to side as indicated by the arrows A—A in FIG. 1. The rear pontoons 14 thus act as rudders to steer the watercraft 10. The rear pontoons are pivoted in unison, as indicated by the arrows B—B, in response to reciprocal movement of steering rods 18 and 20, through a tiller linkage 21.

Mounted on the forward pontoons 12 to fix them rigidly together is a pilot support frame 22 including front and rear cross bars 24 and 26, which rigidly interconnect the forward hulls 12. A pair of fore and aft frame members 28 ad 30 are spaced apart near the rear cross bar 26 to support a seat 32 of a suitable fabric, such as canvass, nylon or the like. The frame members 28 and 30 converge to a closer parallel relationship near the front cross bar 24 to support a rotary gear drive 34 between them. Depending from the rotary drive 34 is a tubular propeller drive shaft housing 36, which rotatably supports a drive shaft (not shown) to drive a propeller 38 extending into the water below the forward pontoons 12. Preferably, a transparent shield 40 of "PLEXIGLAS" or the like is supported on the propeller shaft housing 36 to protect the operator from sprays and/or splashing.

The rotary drive 34 is driven by crank arms 42 on which are carried pedals 44 so that the watercraft 10 is propelled as by pedalling a bicycle. The propeller shaft housing 36 is mounted at 46 to pivot about the axis of the rotary drive 34 so that the propeller 38 and shield 40 may be raised clear of the water, as by means of a pull rod 48. The pull rod 48 is preferably spring mounted at 50 (FIG. 2) to allow the propeller shaft and propeller 36 and 38 to yield in the event it impacts with some underwater impediment. Suitable locking means, such as a clamping screw 52 is provided to hold the pull rod 48 in raised position while the operator or pilot removes any entangled seaweed, or otherwise services the propeller 38.

To augment the pedal drive 42, 44 a pull line 54 is secured to each of the pedal crank arms 42, and attached to the distal end of the line 54 is a suitable pull handle to be manipulated by the operator. Hence, in propelling the twin hulled boat 10, the operator drives each pedal 44 down with leg power in conventional bicycle fashion, and can then pull the pedal back to augment the leg drive by pulling on the handle 56 with arm power.

When not in use, the pull handles 56 may be lodged in a handle holder 58 which is secured to the outside of the fore and aft frame members 28 and 30. A tension line 60 is secured to each pull line 54 intermediate the ends thereof and being directed through a suitable guide 62 is pulled under tension, as by means of a tension spring 64 so that the pull line will not become entangled with the pedals 44 when not in use.

The boat 10 may be steered by the pilot or operator without use of his hands. Hence, the rear pontoons 14 may be pivoted while the operator is using the pull handles 56 to augment the pedal drive. Toward this end, the upright post 66 of a Y-shaped back seat support 68 is pivotally mounted at 70 to the rear cross bar 26 of the pilot support frame 22. A pilot backrest 72 may be extended across the Y-shaped back post 66, 68 to provide support for the pilot's back while propelling the boat 10. Hence, the back support post 66 may be pivoted from side to side, as indicated by the arrows C—C as the operator leans to the side in the direction he wishes to turn.

A post rod 74 is pivoted to the tie rods 18 and 20 at 76 and to the lower end of the seat support post 66, which is pivoted to the frame at 70 at an elevation slightly higher than that of the tie rods so that the lower end of the seat support post 66 will pivot in the direction opposite to that direction the operator leans as indicated by the arrows C—C. The post rod 74 is also mounted to the support frame front 22 in a ball and socket joint that enables it to rotate and pivot on the frame 22.

Figure 2:
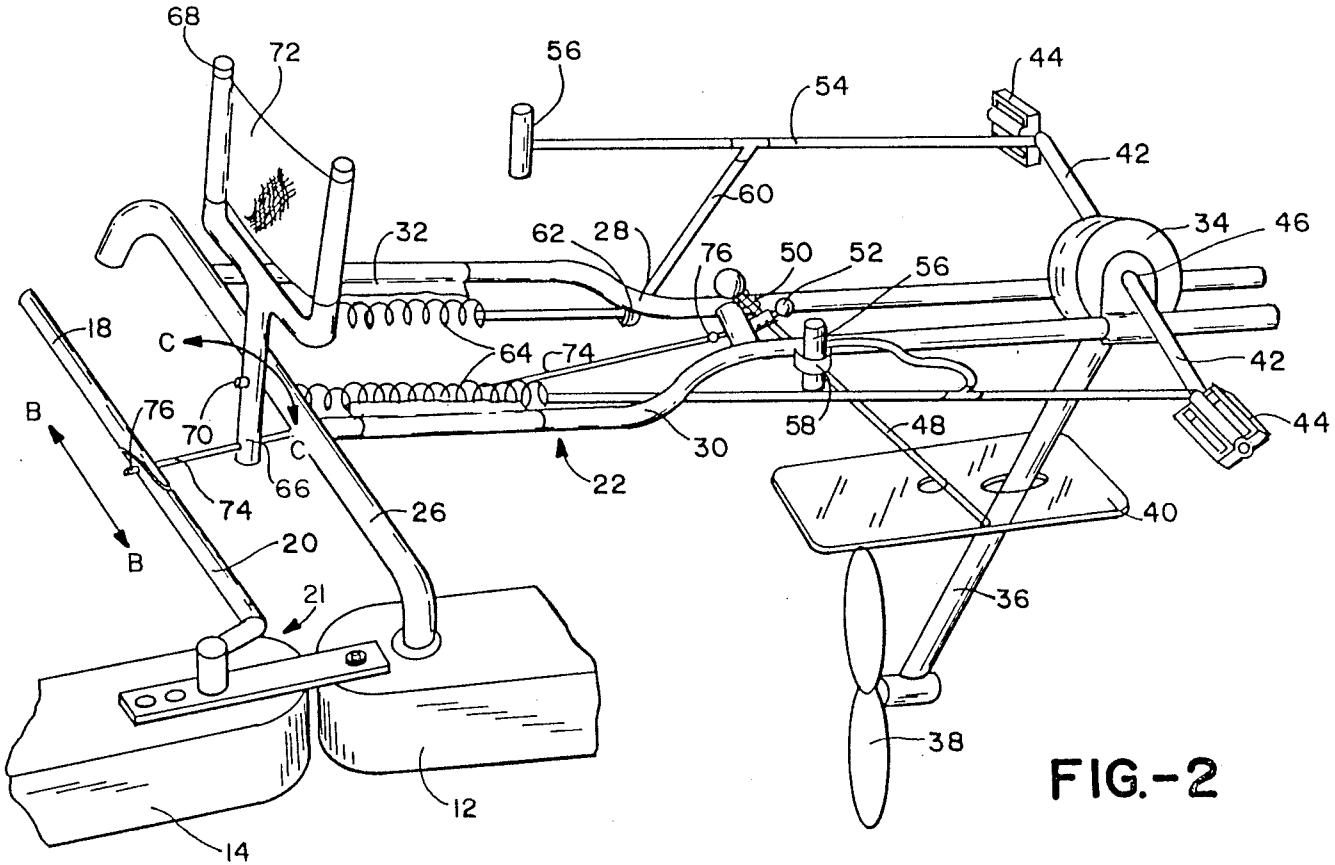
FIG. 2 is a partial view in perspective showing the propelling means for the watercraft.

As shown in FIGS. 1 and 2, should the operator lean to the right to pivot the seat support post 66 with him, the lower end of the post 66 will pivot to the left carrying the steering rods 22 with it. This will pivot the rear pontoons 14 to the right to steer the catamaran 12 in the direction in which the operator is leaning.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A watercraft comprising:

a hull system;

rudder means pivotally mounted on said hull system;

an operator support frame mounted on said hull system;

a seat carried on said support frame;

a tiller linkage connected to operate said rudder means;

means for propelling said watercraft;

pedal means for driving said propelling means; and means for operating said tiller linkage without use of the hands or the arms, comprising:

an upright back support post pivotally carried on said support frame just aft of said seat;

said back support post being pivoted to said tiller linkage so that said tiller linkage is operated by the operator leaning from side to side.

2. The watercraft defined by claim 1 including:

a pair of lines, each secured at one end to said pedal means; and a pull handle on the distal end of each said line to enable the operator to drive a pedal in one direction with a foot and to pull said pedal manually on return.

3. The watercraft defined by claim 2 including:

biasing means secured at opposite ends to the rear of said frame and to one of said lines intermediate the ends thereof to prevent entanglement with a pedal.

4. The watercraft defined by claim 1 wherein:

said hull system comprises a pair of parallel front pontoons; and a pair of parallel rear hull sections hingedly connected to said front pontoons to form said rudder means.

5. The watercraft defined by claim 1 wherein said propelling means comprises:

a propeller shaft depending from said support frame and driven by said pedal means;

and including:

a pull rod to enable the operator to pivot said propeller shaft to raise the propeller from the water; and means for locking the pull rod in raised position.

6. The watercraft defined by claim 5 including:

shield means on said propeller shaft to protect the operator against spray.

7. A water craft comprising:

a pair of parallel front pontoons;

a pair of parallel rear pontoons;

hinge means connecting said rear pontoons to said front pontoons for horizontal articulation thereon;

an operator support frame including a rear cross bar interconnecting said front pontoons;

a steering rod interconnecting said rear pontoons at a different elevation than said rear cross bar;

an upright back support post pivoted to said rear cross bar and to said steering rod so that pivotal movement of said back support post in opposite lateral directions will reciprocate said steering rod; and means for propelling said pontoons through a body of water.

8. The watercraft defined by claim 7 wherein:

said rear cross bar is at a higher elevation than said steering rod so that pivotal movement of said back support post in one lateral direction will push said steering rod longitudinally in the opposite lateral direction.

9. The watercraft defined by claim 7 wherein:

said steering rod is pivoted to said rear cross bar and connected at opposite ends to said rear pontoons so that pivotal movement of said back support post in one lateral direction will pivot said rear pontoons to steer said front pontoons in the same lateral direction.

10. The watercraft defined by claim 7 including:

a pilot seat mounted on said support frame; and a back rest carried on said back support post so that a seated operator can lean to right or left with his back against said back rest to pivot said back support post.

11. The watercraft defined by claim 10 wherein said operator support frame includes:

a front cross bar; and a pair of fore and aft bars secured between said front and rear cross bars;

a pair of pedals rotatably mounted on said frame forward of said pilot seat;

rotary drive means on said frame driven by said pedals;

a propeller shaft depending from, and driven by, said drive means; and a propeller on the lower end of said propeller shaft.

12. A watercraft defined by claim 11 wherein:

said propeller shaft is pivotally mounted on said frame; and including:

means for pivoting said propeller shaft to lift said propeller from the body of water.

13. The watercraft defined by claim 11 including:

a line secured at one end to each of said pedals;

a pull handle on the distal end of each of said line to enable an operator to drive each pedal in one direction with a foot and to pull said pedal manually for return.

14. A watercraft comprising:

a pair of parallel front pontoons;

a pair of parallel rear pontoons;

hinge means connecting said rear pontoons to said front pontoons for horizontal articulation thereon;

an operator support frame including front and rear cross bars interconnecting said front pontoons;

a steering rod interconnecting said rear pontoons;

means for reciprocating said steering rod;

a pair of fore and aft bars secured between said front and rear cross bars;

a pilot seat mounted between said fore and aft bars near the rear thereof;

a pair of pedals rotatably mounted on said frame forward of said pilot seat;

rotary drive means on said frame driven by said pedals;

a propeller shaft depending from, and driven by, said drive means; and a propeller on the lower end of said propeller shaft.

15. The watercraft defined by claim 14 wherein:

said propeller shaft is pivotally mounted on said frame;

and including:

means for pivoting said propeller shaft to lift said propeller from the body of water.

16. The watercraft defined by claim 14 including:

a line secured at one end to each of said pedals;

a pull handle on the distal end of each said line to enable an operator to drive each pedal in one direction with a foot and to pull said pedal manually for return.

17. A watercraft comprising:

a hull system including a pair of parallel front pontoons and a pair of parallel rear pontoons hingedly connected to said front pontoons to form rudder means;

an operator support frame mounted on said hull system;

a tiller linkage connected to operate said rudder means;

means for propelling said watercraft;

pedal means for driving said propelling means; and means for operating said tiller linkage without use of the hands or the arms.

18. The watercraft defined by claim 17 including:

a seat carried on said support frame;

said means for operating the tiller linkage comprising:

an upright back support post pivotally carried on said support frame just aft of said seat;

said back support post being pivoted to said tiller linkage so that said tiller linkage is operated by the operator leaning from side to side.

19. The watercraft defined by claim 17 wherein said propelling means comprises:

a propeller shaft depending from said support frame and driven by said pedal means;

and including:

a pull rod to enable the operator to pivot said propeller shaft to raise the propeller from the water; and means for locking the pull rod in raised position.

20. The watercraft defined by claim 19 including:

shield means on said propeller shaft to protect the operator against spray.

* * * * *